US006233753B1

(12) United States Patent
Battiston

(10) Patent No.: US 6,233,753 B1
(45) Date of Patent: May 22, 2001

(54) HINGED ASSEMBLY FOR TOILET SEAT CONSTRUCTION

(75) Inventor: Joseph Battiston, Chester, VA (US)

(73) Assignee: Tubular Fabrications Industry, Petersberg, VA (US)

( * ) Notice: Subject to any disclaimer, the term of this patent is extended or adjusted under 35 U.S.C. 154(b) by 0 days.

(21) Appl. No.: 09/432,033

(22) Filed: Nov. 2, 1999

(51) Int. Cl.[7] ..... A47K 11/02; A47K 13/12
(52) U.S. Cl. ..... 4/449; 4/236; 4/240; 4/254
(58) Field of Search ..... 4/449, 236, 237, 4/240, 479, 480, 483, 484, 254

(56) References Cited

U.S. PATENT DOCUMENTS

| | | | | |
|---|---|---|---|---|
| 1,052,273 | * | 2/1913 | Pudliner | 4/236 |
| 1,691,176 | * | 11/1928 | Zundel | 4/236 |
| 1,718,482 | * | 6/1929 | Myers | 4/236 |
| 1,825,456 | * | 9/1931 | Henn | 4/236 |
| 2,253,642 | * | 8/1941 | Moore | 4/236 |
| 2,535,789 | | 12/1950 | De Bell . | |
| 2,742,649 | | 4/1956 | Philips . | |
| 2,803,017 | * | 8/1957 | Coggins | 4/236 |
| 2,846,697 | | 8/1958 | Philips . | |
| 3,301,121 | * | 1/1967 | Newcomer | 4/236 |
| 3,829,908 | * | 8/1974 | Thomas | 4/483 |
| 4,639,147 | | 1/1987 | Schwarz . | |
| 4,985,939 | | 1/1991 | Otte . | |
| 5,450,633 | | 9/1995 | Semmler . | |
| 5,918,321 | | 7/1999 | Oile . | |
| 6,006,369 | * | 12/1999 | Bly | 4/236 |
| 6,009,571 | * | 1/2000 | Battiston et al. | 4/483 |

* cited by examiner

*Primary Examiner*—Charles R. Eloshway
(74) *Attorney, Agent, or Firm*—Klauber & Jackson

(57) ABSTRACT

A commode is disclosed having a specially configured bolts to secure the commode seat to the frame of the commode. The bolts are affixed to a back bar of the commode frame and have a straight portion adapted to be secured to the back bar and an angled portion to be secured pivotally to the rear of the commode seat. The straight portion and the angled portion are formed together with an intermediate arcuate portion to form an acute angle with respect to each other. In the assembled commode, the straight portion of the bolts extends horizontally rearwardly from the back bar so as to avoid damage to a household toilet when the commode is positioned atop the toilet. In addition, by the special configuration, the rear of the commode seat is positioned vertical directly above the back bar to prevent the commode seat from falling any appreciable distance downwardly in the event of a failure of one or both of the special bolts.

9 Claims, 3 Drawing Sheets

HINGED ASSEMBLY FOR TOILET SEAT CONSTRUCTION

FIELD OF THE INVENTION

The present invention relates generally to the mounting of the frame of a commode seat to a commode or like seating device, and, more particularly, to a pair of mirror image bolts that are fastened to the commode or seating device so as to have a portion that extends generally horizontally rearwardly from the point of attachment to the rear frame member of the commode, an angled straight portion and an intermediate arcuate portion, the angled straight portion and the straight portion forming an acute angle with respect to each other.

BACKGROUND OF THE INVENTION

Typically, commodes are regularly used by elderly or infirmed persons to aid in the convenience of use by such persons that cannot use, or for some reason find it difficult to use, the normal porcelain toilet commonly used in households today. By definition, the use of the word commode and toilet are sometimes used interchangeably for both of the devices and thus, in order to provide clarity, the use of the words hereinafter in the present description will be to use the term commode to describe the present device that is portable and movable to aid the person and the term toilet will be used to describe the typical porcelain device that is of the standard household variety.

With the use of commodes, there are at least two somewhat independent uses. One is where the commode is serving as an independent device and is interfitted with a pail having a solid bottom to catch and retain the waste products at any convenient location to the user, such as bedside. Such commodes are generally comprised of a relatively light frame, normally of a metal tubular construction, and are easily movable to desired locations and may even include wheels that are lockable into a fixed position to allow the device to be rolled along the floor to the location of choice. An alternate use, however, of the commode is to move or otherwise position the device to be located physically over the standard toilet so that, in effect, the user has the convenience and comfort of the commode configuration but uses the standard toilet for the disposal of the waste products. In the latter use, obviously, the pail has no bottom and operates more in the form of a splash guard to direct the waste products into that standard toilet.

One disadvantage in the latter use of a commode is in the location of the bolts that fasten the commode seat assembly to the frame. The seat assembly normally includes a seat on which the person is situated and a cover overlying that seat and covering the underneath components when the commode is not in use. Both the seat and the cover are conventionally pivotally affixed with respect to the frame to enable the user to individually lift the cover into its usable and non-usable positions and to also raise the seat for access to the pail for disposal of the waste products or for removal of the pail or splash guard for cleaning. As such, the securing bolts are normally affixed in some manner to the commode seat to allow that pivoting movement and securely affixed to one of the frame members of the commode, preferably a back bar as will be explained. The bolts are conventionally affixed to the back bar or other frame member by passing the threaded ends of such bolts vertically downwardly through the frame member and securing the bolts to that frame member by affixing nuts to the threaded ends to be tightened and complete the assembly.

The difficult arises, therefore, in the positioning of the vertically oriented threaded ends into the frame the member. When assembled, the lower ends of the threaded bolts project through the nuts for a finite distance and those bolt ends thus project outwardly of the nuts in a downward vertical direction. When the commode is used over the standard porcelain toilet, therefore, the lower ends of the bolts can cause considerable damage to the porcelain finish of the toilet and which is certainly an undesirable situation. Since the commode, as indicated, is used over the standard household toilet, damage to the porcelain can permanently affect the look of the toilet and the physical damage not readily repairable.

Accordingly, it would be desirable to provide de differing orientation and positioning of the bolts that secure the seat to the commode so as to not cause permanent damage to the porcelain toilet in the household.

As a further problem with commodes, the rear of the commode seat is supported above the back bar by bolts but the rear of the seat is normally situated inwardly disposed with respect to the back bar and thus, in the event of a failure of the rear support bolts, the seat can collapse downwardly and will not be restrained from full downward movement by that back bar. Thus, the seat is capable of collapsing downwardly with the person positioned on the seat.

It would thus also be desirable to provide a system where the bolts not only hold the rear of the seat firmly in position, but position the rear of the seat directly vertically above and in alignment with the back bar support such that, in the event of a failure of one or both of the bolts, the rear of the seat will fall downwardly only a slight distance and then be fully supported and prevented from further downward movement by that strong support of the back bar.

SUMMARY OF THE INVENTION

Therefore, in accordance with the present invention, a commode construction is provided that overcomes the difficulties and problems of the aforedescribed commodes and which has a frame on which the person can be situated with the frame having a front to which the person faces and a rear facing the back of the person. The frame is preferably of a tubular construction and includes a support member or back bar at the rear of the frame to provide support and is a structural member of the frame. A pair of specially constructed bolts are used to secure the commode seat to the frame and each bolt is a mirror image of the other. The bolts each have a generally straight portion having a threaded end that is inserted through the back bar and that straight portion, when so inserted, extends horizontally rearwardly from the back bar so as to prevent any damage to a porcelain toilet when the commode is positioned atop the toilet. The bolts are shaped so as to form an angled straight portion with an intermediate arcuate portion between the straight portion and the angled straight portion. The arcuate portion configures a curving shape that leads into the upward angle and forward direction to the angled straight portion.

The angled straight portion terminates in upper ends that are shaped so as to interfit with the seat and to allow that seat to pivot with respect to the fame. In the preferred embodiment, the upper ends that interfit with the commode seat are formed at an angle from the angled straight portion and more preferred, the straight portion the arcuate portion and the angled straight portion are in a common plane that is vertically oriented and the upper ends are formed at about a 90 degree angle with respect to that plane. Thus, in the preferred embodiment, the upper ends of the angled straight portion can simply be inserted into horizontally disposed bores in the seat itself to support the seat to the frame. Since the bolts are mirror images of each other, they can be used with a commode seat where the upper ends are inserted into the bores outwardly with respect to the seat or, by reversed the bolts, they can be used in an orientation where the ends of the arcuate portion are inserted inwardly into the bores in the seat.

By the particular curvature and the vertical height of the bolts of the present invention, the rear of the seat can be positioned directly vertically above the back bar and be oriented so that, in the event either or both of the bolts fail, the rear of the seat will only fall a short distance whereupon the rear of the seat will hit upon and be supported by the back bar. Thus, in the event of such failure, the person only moves downwardly a slight amount, possibly an uncomfortable but safe distance.

Other features and advantage will become apparent to those skilled in the art from a review of the ensuing description while proceeds with reference to the following illustrative drawings.

BRIEF DESCRIPTION OF THE DRAWINGS

FIG. 5 is a rear view as in FIG. 4 with the bolts of the present invention in an alternate orientation.

DETAILED DESCRIPTION

Figure 1:
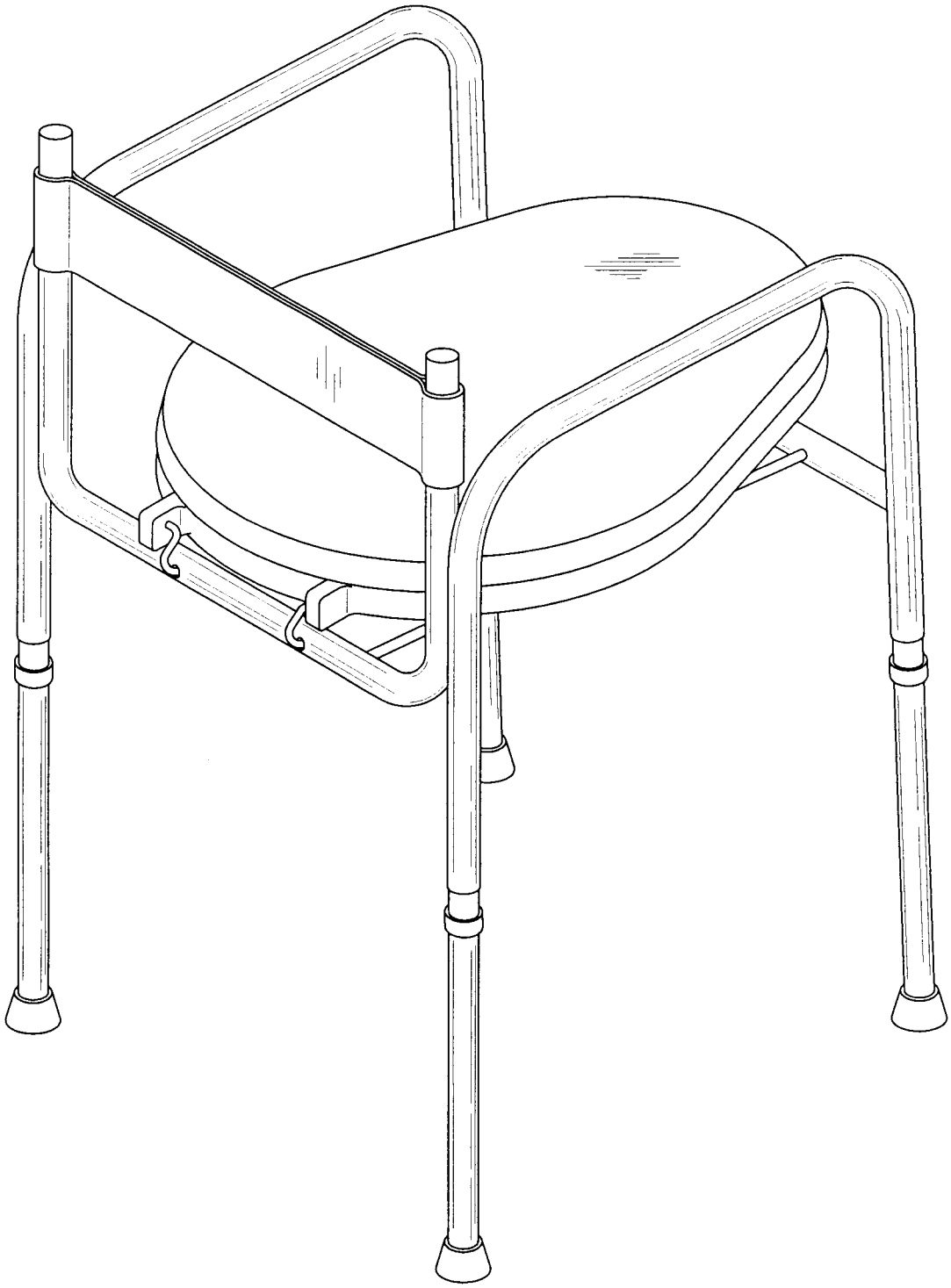
FIG. 1 is a perspective view of a commode constructed in accordance with the present invention.

Referring now to FIG. 1, there is shown a perspective view of a commode 10 constructed in accordance with the present invention. As can be seen, commode 10 comprises a pair of inverted U-shaped side frame members 12 that are spaced apart to provide a seating space for the user therebetween in utilizing the commode 10. As used herein, by convention, the front of the commode 10 will be referred to as the direction the user is facing when seated in the commode 10 and thus, in FIG. 1, the frame members 12 are shaped so as to include front legs 14 and rear legs 16, each of which may have flexible cups 18 attached to the bottom of such legs to prevent the commode 10 from slipping on the floor or to form deep indentations in a carpet. Each of the front legs 14 and the rear legs 16 may also include some adjusting mechanism 20 as is conventional to allow the telescoping legs to be extended or retracted to adjust the commode 10 to the desired height from the floor to be convenient to the user.

As also can be seen, there is a front bar 22 and a back bar 24, in accordance with the defined convention, to provide support for the overall frame assembly for rigidity and integrity of the commode 10. The back bar 24 may be part of a U-shaped back member 26 and which can also provide a means of positioning a back support 28 that supports the back of the user during use of the commode 10.

A further pair of bars 30 (only one of which is shown in the Figure), also adds to the structural integrity of the commode 10 by connecting the front bar 22 and the back bar 24. A commode seat 32 is affixed to the frame and, as shown, the commode seat 32 is supported by the back bar 24 in a manner that will be later explained. It is to sufficient to note that the commode seat 32 is pivotally mounted with respect to the frame so that it can be raised and lowered by the user. As shown, it is in its lowered position. Atop the commode seat 32, there is positioned a cover 34 that is also pivotally affixed with respect to the frame and to the commode seat 32 so that the commode seat 32 and the cover 34 can be independent raised and lowered by the user.

As can be seen in FIG. 1, two specially constructed bolts 36 are used to affix the commode seat 32 to the back bar 24 and, although the embodiment utilizes two of such bolts, in some fairly rare instances, more than two bolts 36 could be used in the commode 10 to secure to the commode seat 32 to the back bar 24.

Figure 2A:
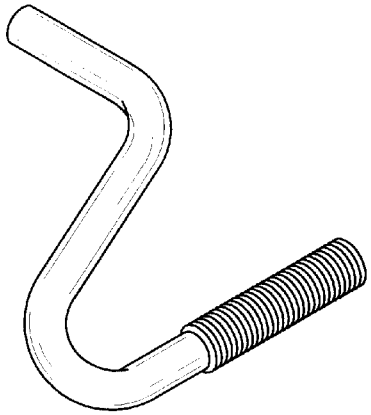
FIGS. 2A and 2B are perspective views of the particular bolt used in the present invention.
Figure 2B:
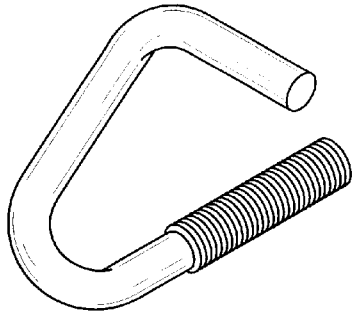

Turning now to FIGS. 2 and 2B, taken in connection with FIG. 1, there is shown perspective views of the bolts 36 that are the essence of the present invention and are specially formed to carry out the purposes hereof. As shown, the bolts 36 are mirror images of each other and therefore the description of only one of the bolts 36 will be sufficient to fully set forth the invention. Thus, in FIG. 2A, the bolt 36 includes a straight portion 38 that, in the assembled condition, extends rearwardly and horizontally from the back bar 24. The forward part of the straight portion 38 has a threaded end 40, the purpose of which will be late explained. Located rearwardly of the straight portion 38 is an arcuate portion 42 that is configured as a bend that again turns forwardly into an angled straight portion 44. As can be seen, the angled straight portion 44 forms an angle with the straight portion 38 and preferably that angle is an acute angle shown as the angle A and, more preferably, the angle A is about 40 degrees. In the preferred embodiment, the straight portion 38, the arcuate portion 42 and the angled straight portion 44 are all in a common plane, and when installed as in FIG. 1, that plane is preferably a vertical plane.

At the uppermost part of the angled straight portion 44 there is an upper end 46 that is adapted to be affixed to the commode seat 32 in a manner that allows the commode seat 32 to pivot about that upper end 46. Again, in the preferred embodiment, where the straight portion 38, the arcuate portion, and the angled straight portion 44 of bolt 36 are all in a common plane, vertically disposed when assembled, the upper end 46 extends outwardly at a right angle to that plane, thus the upper end 46, when assembled, extend generally horizontally.

Figure 3:
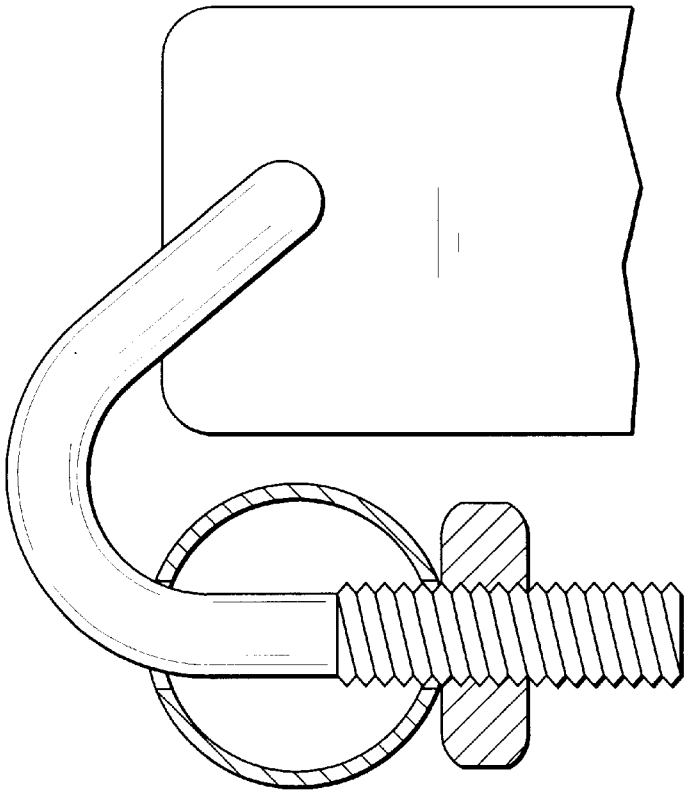
FIG. 3 is a enlarged side view, partly in section, showing the support of a commode seat to a back bar through use of a bolt of the present invention.

Turning now to FIG. 3, there is shown a side view, partly in cross section, showing the commode seat 32 supported by the back bar 24 by means of bolt 36 configured in accordance with the present invention. As can be seen, therefore, the back bar 24 is a cylindrical tube, preferably of a rigid metal construction, and has two similar sized holes 48, 50 drilled horizontally through the back bar 24. Thus, in securing the bolt 36 to the back bar 24, the straight portion 38 is inserted forwardly through the two holes 48, 50 and a nut 52 is secured to the threaded end 40 to firmly secure that bolt 36 to the back bar 24. The arcuate portion 42 thus abuts against the upper edge of the rear hole 48 and prevents the straight portion 38 from further entering the back bar 24 so that the tightening of the nut 52 can hold the bolt 36 in its position as shown.

To affix the upper end 46 of the bolts 36 to the commode seat, the upper ends 46 are slipped into bores 54 formed laterally in the commode seat 32. Thus, the commode seat 32 can be pivoted about the upper ends 46 by the interfitting of the upper ends 46 within the bores 54 so that the commode seat can be raised and lowered to the desired position.

Thus, the commode seat 32 is held to the back bar 24 and is vertically positioned above that back bar 24. In FIG. 3, it can be seen that by the particular configuration of the bolts 36 the rear end of the commode seat 32 can extend to be vertically directly above the back bar 24 and, accordingly, in the event of a failure of either or both of the bolts 36, the commode seat 32 can only drop a small amount before it hits the back bar 24 and is thereafter fully supported by that back bar 24. Therefore, even in the event of such failure, the user experiences only a slight drop in the commode seat 32 and suffers only a minor inconvenience.

Figure 4A:
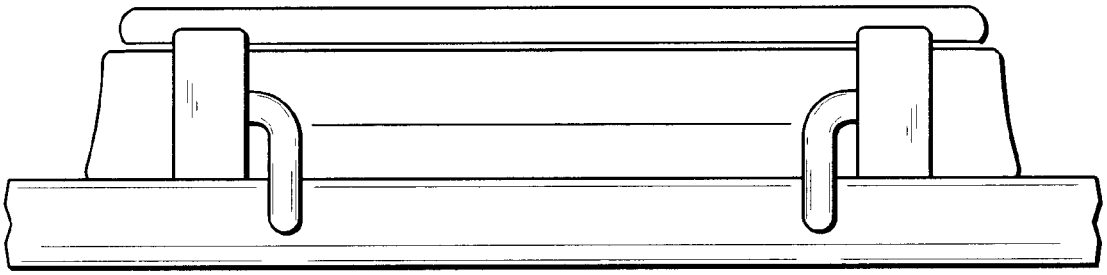
FIG. 4 is a rear view showing the commode seat secured to the back bar of a commode with the bolts of the present invention in one orientation.
Figure 4B:
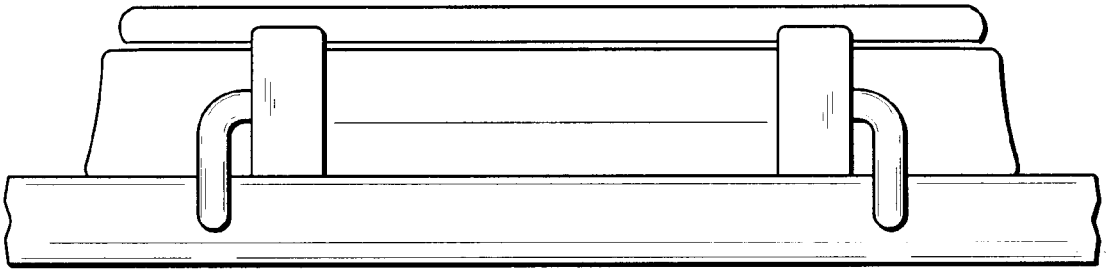

Turning, finally to FIGS. 4A and 4B, there is shown a rear view of the commode seat 32 in its assembled position to the back bar 24. In the FIG. 4A embodiment, the bolts 36 are assembled such that the upper ends enter outwardly into the bores 54 in the commode seat. In the embodiment of FIG. 4B, the same bolts 36, having been reversed, can now interfit inwardly into the bores 54 in the commode seat 32. Thus, the same bolts 36 by reversing their positions, can be used interchangeably where the bores 54 in the commode seat are directed outwardly or inwardly without modifications or changes to the bolts 36.

It is understood that the invention is not limited to the illustrations described and shown herein, which are deemed to be merely illustrative of the best modes of carrying out the invention, and which are suitable of modification of form, size, arrangement of parts and details of operation. The intention rather is intended to encompass all such modifications which are within the spirit and scope and defined by the claims.

I claim:

1. A commode comprising, a tubular frame having a front and a rear to allow a person using the commode to face toward the front of the frame, said frame having a support member extending across the rear of said tubular frame, and a commode seat pivotally affixed to said support member by means of at least two arcuate bolts, each of said at least two bolts adapted to be affixed to said support member and having a generally straight portion affixed to said support member and extending rearwardly and generally horizontally therefrom and said at least two bolts further having an angled straight portion extending upwardly and frontwardly from said straight portion through an intermediate arcuate portion, said angled straight portion and said straight portion being at an acute angle, said at least two bolts terminating in upper ends disposed vertically above said straight portions to be affixed to the commode seat.

2. A commode as defined in claim 1 wherein said acute angle is about 40 degrees.

3. A commode as defined in claim 1 wherein said upper ends are disposed directly vertically above said support member.

4. A commode as defined in claim 1 wherein said straight portion, said arcuate portion and said angled straight portion are all in a common plane.

5. A commode as defined in claim 4 wherein said upper ends extend laterally with respect to said common plane.

6. A commode as defined in claim 4 wherein said common plane is vertically oriented and said upper ends extend at a right angle with respect to said vertical plane.

7. A commode as defined in claim 6 wherein said commode seat has bores formed to be oriented outwardly and said upper ends extend outwardly from said angled straight portion and said upper ends interfit outwardly into said bores to affix said commode seat pivotally thereto.

8. A commode as defined in claim 6 wherein said commode seat has bores formed to be oriented inwardly and said upper ends extend inwardly from said angled straight portion and said upper ends interfit inwardly into said bores to affix said commode seat pivotally thereto.

9. A commode as defined in claim 1 wherein each of said straight portions has a threaded end that passes through horizontally disposed holes in said support member, said arcuate portion abutting against an edge of one of said holes and having a nut tightened to said threaded end to abut against said support member adjacent the other said hole.

* * * * *